US006607371B1

(12) United States Patent
Raymond et al.

(10) Patent No.: US 6,607,371 B1
(45) Date of Patent: Aug. 19, 2003

(54) PNEUDRAULIC ROTARY PUMP AND MOTOR

(76) Inventors: Charles D. Raymond, P.O. Box 940, Queen's Hwy., Sigatoka (FJ); William W. Eschenbach, 16869 Lauri La., Occidental, CA (US) 95465

( * ) Notice: Subject to any disclaimer, the term of this patent is extended or adjusted under 35 U.S.C. 154(b) by 0 days.

(21) Appl. No.: 08/937,220

(22) Filed: Sep. 10, 1997

Related U.S. Application Data

(63) Continuation-in-part of application No. 08/714,383, filed on Sep. 16, 1996, now abandoned.

(51) Int. Cl.[7] ..... F01C 1/34; F01C 11/00

(52) U.S. Cl. ..... 418/6; 418/11; 418/172; 418/175; 418/176; 418/177; 418/212; 418/225

(58) Field of Search ..... 418/6, 11, 12, 418/172, 175, 176, 177, 209, 212, 225

(56) References Cited

U.S. PATENT DOCUMENTS 1,872,361 A * 8/1932 Tackman ..... 418/6
2,392,029 A * 1/1946 Davis ..... 418/175
2,521,592 A * 9/1950 McManus ..... 418/6
5,073,097 A * 12/1991 Pipalov ..... 418/175
5,375,985 A * 12/1994 Pipaloff ..... 418/175

* cited by examiner

*Primary Examiner*—John J. Vrablik

(57) ABSTRACT

Expansible chamber apparatus for a positive displacement, high volume, low friction, reversible rotary pump for gases and/or liquids. Two or more chambers are provided, defined in part by one or more small abutments that move radially in a slot to switch or redirect fluid flow with minimal loss of fluid mechanical energy. A complementary pair of chambers, formed by a single groove, is radially divided by a concentric land ring and is longitudinally segmented by the abutment, which seals the chambers against reverse leakage. The abutment is slightly smaller in radial dimension than the groove and is floated to avoid hard contact with the inner and outer land ring surfaces of the groove by a balancing of the Bernoulli effects that develop. The apparatus can also be operated as a fluid compressor, as a motor and in other applications, in single cycle or multiple cycle operation. The pump provides substantially non-pulsating fluid flow in one or more stages.

19 Claims, 15 Drawing Sheets

ROTOR AT 0°

ROTOR AT 270°

ROTOR AT 90°

ROTOR AT 180°

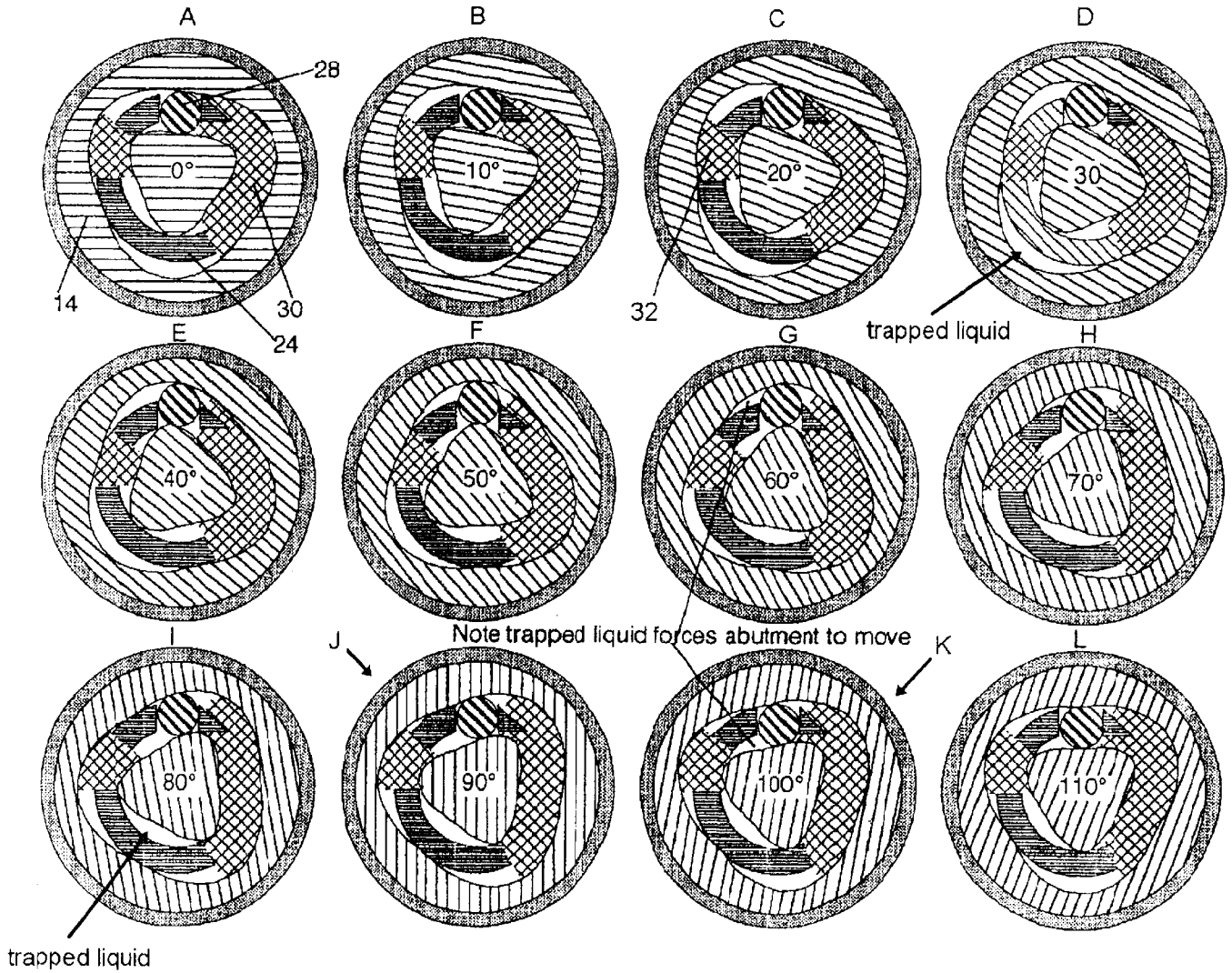
FIG. 10 A-L

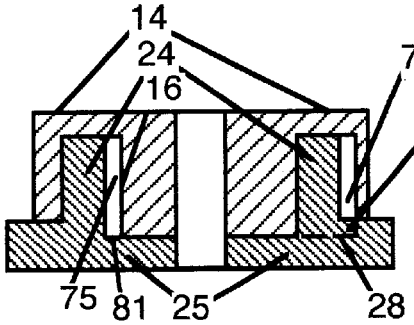
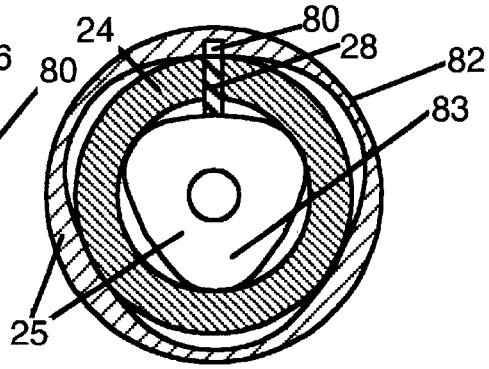
Figs. 13A 13B
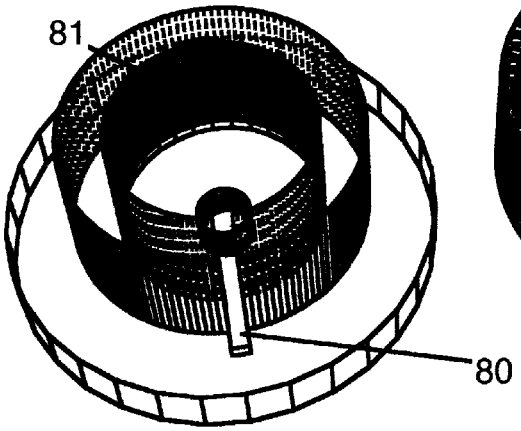
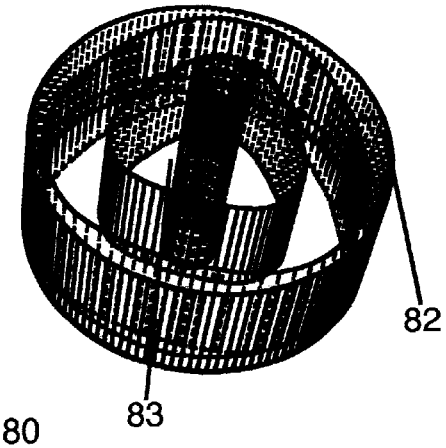
Fig. 13C Fig. 13D

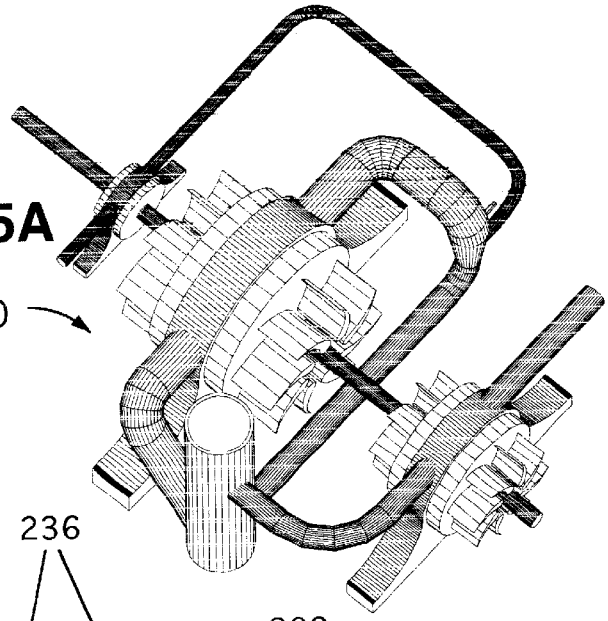
Fig. 15A
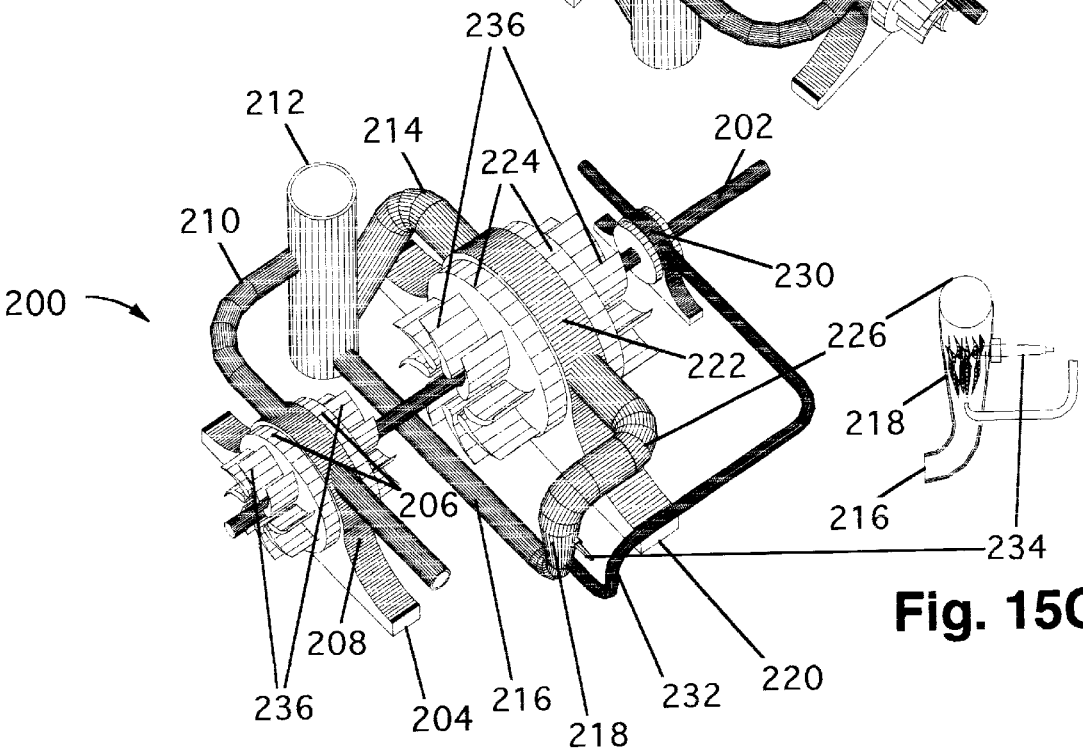
Fig. 15C
Fig. 15B

PNEUDRAULIC ROTARY PUMP AND MOTOR

This application is a Continuation In Part of a patent application, U.S. Ser. No. 08/714,383, filed on Sep. 16, 1996, abandoned. The present invention relates generally to rotary pumps and more particularly to gas and liquid expansible-chamber rotary pumps, motors, compressors and expanders characterized by positive displacement, high volume, and low friction operation.

FIELD OF THE INVENTION

Description of Related Art

Prior art rotary positive displacement motor and pump devices have directed themselves to improving mechanical, hydraulic, and volumetric efficiencies, increasing longevity, making manufacturing easier, improving the size-to-delivery and weight-to-delivery ratios, and to including the ability to run dry without damage. Many conventional positive-displacement rotary pumps are based on a chamber with expanding and contracting volumes that provide a pumping action. Such devices usually depend on a vane, lobe or piston that is mechanically swept by a cam, crank, lever, or gear.

Piston pumps include connecting rods and crankshaft or a swash plate, and are heavy apparatus that require lubrication. This makes the efficiency of the apparatus low, because a heavy weight needs to be repeatedly started and stopped. In addition, the friction of the seals (piston rings, in this case) robs power, and requires lubrication. Vane pumps also have metal parts that are repeatedly started and stopped. These parts have sliding friction as well as momentum, and have a pressure-loaded mechanical or hydraulic seal. In addition, these pumps require complex porting for hydraulic loading of the seals. Gear or lobe pumps are better, as the abutment has a rotary motion. However, precision gearing is required, and there is significant friction as well. Screw type pumps suffer from the same difficulties, and are even harder to manufacture. Nutating and gyrotor pumps require complex gearing or other assemblies to give them the special motion that characterizes them. Finally, flexible impeller pumps, although they are sold in the hundreds of thousands, have serious friction losses, and they cannot be run dry without damaging the impeller.

The closest related art found was C. F. Davis, Jan. 1 1946, U.S. Pat. No. 2,392,029, which discloses a rotor with elliptical groove and a land ring and two disk-like cylindrical abutments. However, his device has a number of differences from the present invention.

First, the ports are small and of the wrong shape, so that the device will not work well as a practical pump. Second, the Davis et al invention provides only a line contact seal between the land ring and the groove in the rotor. Third, although it is asserted that the Davis et al invention will provide non-pulsating flow, it will not do so. This is because the two sides of the pump are in phase, and so their large discharges and small discharges coincide. Fourth, in the Davis patent the ports are described as being rotary valved. Thus, the ports are completely closed during part of the cycle, so the fluid is forced to stop and start, causing large hydraulic losses.

What is needed is a rotary pump that has little or no frictional or other energy losses, has little or no mechanical wear and that can be utilized in many different applications.

SUMMARY OF THE INVENTION

An object of the present invention is to provide a rotary pump with at least two chambers and a near frictionless abutment balanced between the chambers that does not present a load that rubs on the walls of the chambers.

A further object of the present invention is to provide a rotary pump with high mechanical and volumetric efficiencies.

Another object of the present invention is to provide a near frictionless rotary pump subject to minimum wear.

A further object of the present invention is to provide a reversible rotary, high-speed, positive displacement pump and motor with very little friction that can deliver relatively high flow rates at moderate to high pressures with good overall efficiency while also being able to run dry without damage.

A still further object of the present invention is to provide rotary motors and pumps that can easily be multiple staged in a single unit and provide non-pulsating efficient liquid flow.

Another object of the present invention is to provide a heat engine using Brayton, or other thermodynamic cycles, that is easy to manufacture, simple, durable, and low-cost.

Briefly, a rotary pump embodiment of the present invention comprises a complementary pair of expansible chambers (or lobes) radially divided by a land ring and longitudinally segmented by an abutment that seals the chambers against reverse leakage. The pair of expansible chambers is formed from a single groove in the end face of a rotor. The land ring divides the pair of chambers into complementary expansible chambers, is concentric on the end face of a stator, and extends fully into the groove. The inner and outer land rings of the groove have a constant radial separation dimension, and the abutment is urged to follow the eccentricity of the groove by positioning of the abutment in a slot in the land ring. The abutment is slightly smaller in radial dimension than the groove and is floated to avoid hard contact with the inner and outer land rings of the groove by a balancing of the Bernoulli effects that develop between the abutment and both the inner and outer land rings of the groove. Preferably, the abutment is approximately spherical and can roll in the slot radially inward and outward.

An advantage of the present invention is that a rotary pump is provided that is nearly frictionless.

Another advantage of the present invention is that a rotary pump is provided that exhibits very high mechanical and volumetric efficiencies.

A further advantage of the present invention is that it provides rotary motors and pumps which can easily be arranged to form multiple phased, parallel and serial stages in a single assembly, to thereby provide smoothed, high volume, and high pressure liquid flow.

Another advantage of the present invention is that a heat engine is provided using Brayton, and other thermodynamic cycles, that is easy to manufacture, simple, durable, and low-cost.

A still further advantage of the present invention is that a tolerance pump or motor is provided with no contacting surfaces. As such, the mechanical efficiency is essentially a function of the viscosity of the pumped liquid or gas.

Another advantage of the present invention is that embodiments can be made with only three main parts: the rotor, the stator, and the abutment. Standard milling techniques can be used to fabricate such components by casting, injection molding, sintering, or other high-volume, low cost manufacturing processes. Still further objects and advantages will become apparent from the following description and accompanying drawings.

BRIEF DESCRIPTION OF THE DRAWINGS

FIGS. 10A–10L is a sequence of views showing how the land ring can be made to trap fluid (cross-hatched region) between the rotor groove, the land ring, and the abutment. The trapped fluid causes the abutment to move in the desired direction due to hydraulic or pneumatic force.

FIG. 13A cross section of another embodiment of this pump, through the middle of the shaft. In this embodiment, the outer chamber 76 is of shorter axial length than the inner chamber 75 in order to provide non-pulsating flow. The dotted line shows a recess for the abutment 80.

FIG. 13B is a cross section through the stator for FIG. 13A at the height of the middle of the abutment. It shows a land ring 24 having a slot for the abutment 28. The slot 80 extends into the raised area of the stator as shown by the dotted line in FIG. 13A. The purpose of this embodiment is to provide a single rotor, single groove pump-motor which has the inner chamber swept volume equal to the outer chamber swept volume for constant flow, constant torque operation FIGS. 13C and 13D are three-dimensional views of the stator and rotor respectively of the same embodiment. Note that the outer part of the rotor 82 is shorter axially than the inner part 83, and that the inner part of the stator has a recess 81 to match the inner (longer) part of the rotor 83. 13C also shows the slot 80 to allow the abutment 28 to completely seal off the chambers.

FIG. 14B is a cross section through the rotor for FIG. 14A at the height of the middle of the abutment. It shows a two lobed (three cycle) rotor with rotor groove having 10° sectors of constant radius and 80° sectors of changing or transition radius.

FIGS. 14C and 14D are cross sections through the rotor for FIG. 14A, showing the rotor in two different positions during a cycle.

FIGS. 15A through 15C show two opposing external views and a detail cross section of a heat engine embodiment of the present invention, referred to herein by the general reference numeral 200. It has a multistage compressor and a multistage expander, referred to herein by the general reference numerals 204 and 220 respectively.

DETAILED DESCRIPTION OF THE INVENTION

Figure 1:
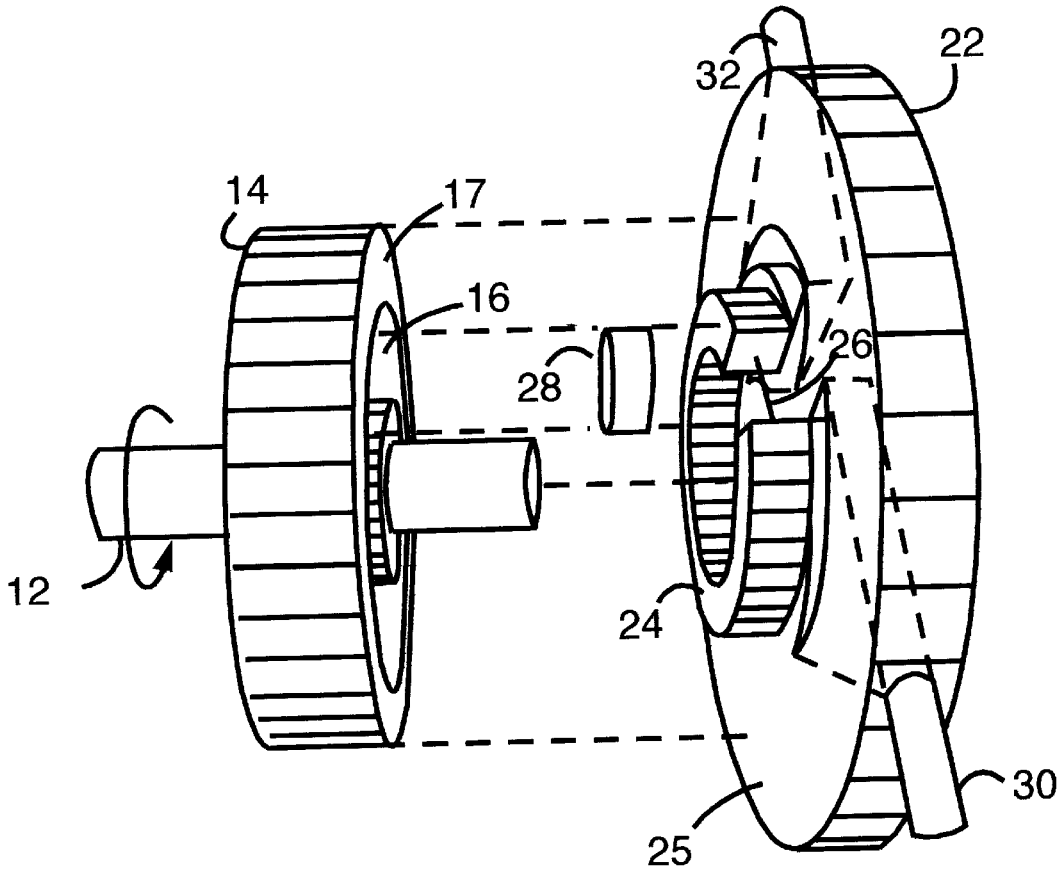
FIG. 1 is a perspective view of a first rotary pump embodiment of the present invention.
Figure 2A:
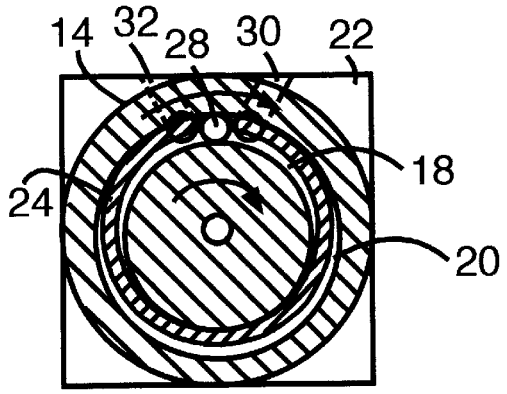
FIGS. 2A–2D are cross sections of the expansible chambers of the rotary pump of FIG. 1 shown during operation at rotor phases of 0°, 90°, 180°, and 270°.
Figure 2D:
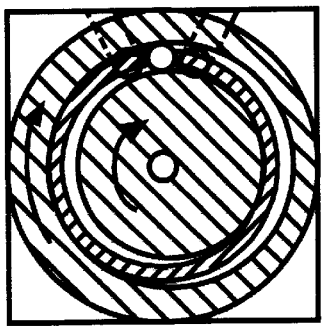
Figure 2B:
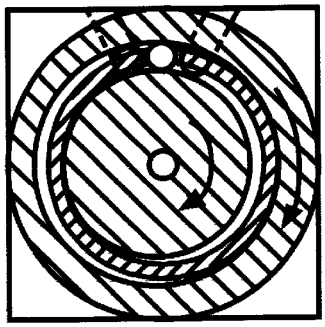
Figure 2C:
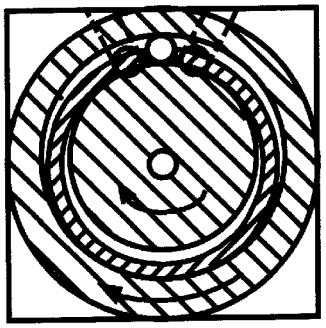

FIG. 1 represents a rotary pump embodiment of the present invention, referred to herein by the general reference numeral 10. The rotary pump 10 comprises a shaft 12 fitted with a cylindrical coaxial disc rotor 14 with an annular groove 16 and a flat end face 17 that is perpendicular to the main axis of rotation. The annular groove 16 preferably has radial width w and axial depth d that are both constant. In order to provide pumping, the whole of the annular groove 16 is not concentric with the axis of the shaft 12 or the rotor 14. For example, the groove 16 may have a rectangular cross section.

A pair of complementary inner and outer expansible chambers 18 and 20 (FIGS. 2A–2D) are formed by positioning the groove 16 close to a stator 22 with a protruding annular land ring 24. The stator 22 has a flat wall 25 that faces and is parallel to the flat wall 17 of the rotor 14. The annular land ring 24 divides the groove 16 into an inner chamber 18 and an outer chamber 20 (FIGS. 2A–2D). The land ring 24 includes a slot 26 with a slot width and a slot depth are about equal to the radial width w and the axial depth d, respectively, of the groove 16, and the slot is fitted with an abutment 28. In one embodiment of the present invention, the abutment 28 has a rectangular cross section and is shaped like a cylindrical disc having a diameter almost equal to the radial width of the chamber 16 and an axial length almost equal to the axial depth of the chamber 16. The abutment 28 seals the inner and outer expansible chambers against reverse leakage and resembles a vane or piston ring, albeit without the friction created by such prior art structures.

The abutment 28 partially depends on the Bernoulli effect to float the abutment between the inner and outer walls of the groove 16, and this effect reduces frictional contact to a minimum. Because the abutment 28 radially oscillates within the groove 16 and the slot 26, the abutment is also preferably configured to have a rolling contact inside the slot 26. See the discussion of FIG. 7 in the following. An inlet port 30 and a discharge or outlet port 32 are positioned in the stator 22 on either side of the abutment 28 and slot 26 and provide for fluid flow (liquid or gas) through the pump 10. As the shaft 12 and rotor 14 rotate, such fluid is forcibly drawn from the inlet port 30 into both expansible chambers 18 and 20 (FIGS. 2A–2D) in opposite phases and is simultaneously pushed out through the discharge port 32.

In operation, as shown in FIGS. 2A–2D, the expansible chambers 18 and 20 expand and contract in their radial dimensions only. The expansible inner chamber 18 contracts when the expansible outer chamber 20 expands, and conversely. Such phasing tends to reduce pump pressure pulsing at the outlet port 32. The chambers 18 and 20 are bounded by the abutment 28, and the pressures developed appear on the surface of the abutment 28. The slot 26 is preferably formed such that fluid pumping pressure forces acting the abutment 28 are continuously perpendicular to the inside land of the slot 26 and the abutment 28 is equally free to move in either radial direction.

The abutment 28 is typically the only component in the pump 10 that accelerates and decelerates during normal operation. Its motion is wholly controlled by the pressure and motion of the fluid that immerses it and seeps by. Such seepage tends to balance between the inside and outside contacts with the groove 16, due to the Bernoulli effect. Thus the abutment 28 does not ordinarily touch the inside walls or the groove 16 and this feature reduces friction and wear common to prior art pumps.

For a single groove 16 divided by the annular land ring 24, the two chambers 18 and 20 are complementary, but the inner chamber 18 is usually smaller in volume than the outer chamber 20. This imperfect matching of the chamber volumes can cause an imbalance in the pumping actions and result in a pulsation of the output flow. In alternative embodiments, it is possible to construct a pump or motor with two opposed rotors and grooves that are 180° out of phase with one another in order to eliminate pulsing. Such additional stages may be arranged in axial or radial order, or as two superimposed stepped grooves (one inside the other) requiring two abutments.

A stator 22 with opposed rotors allows the making of staged units wherein the output of one stage is fed directly into the input of the next stage. Each rotor 14 may have multiple cycles and also have may multiple grooves in the rotor so that staging may be done either radially or by porting across the stator face to the opposing rotor, or both.

Figure 3:
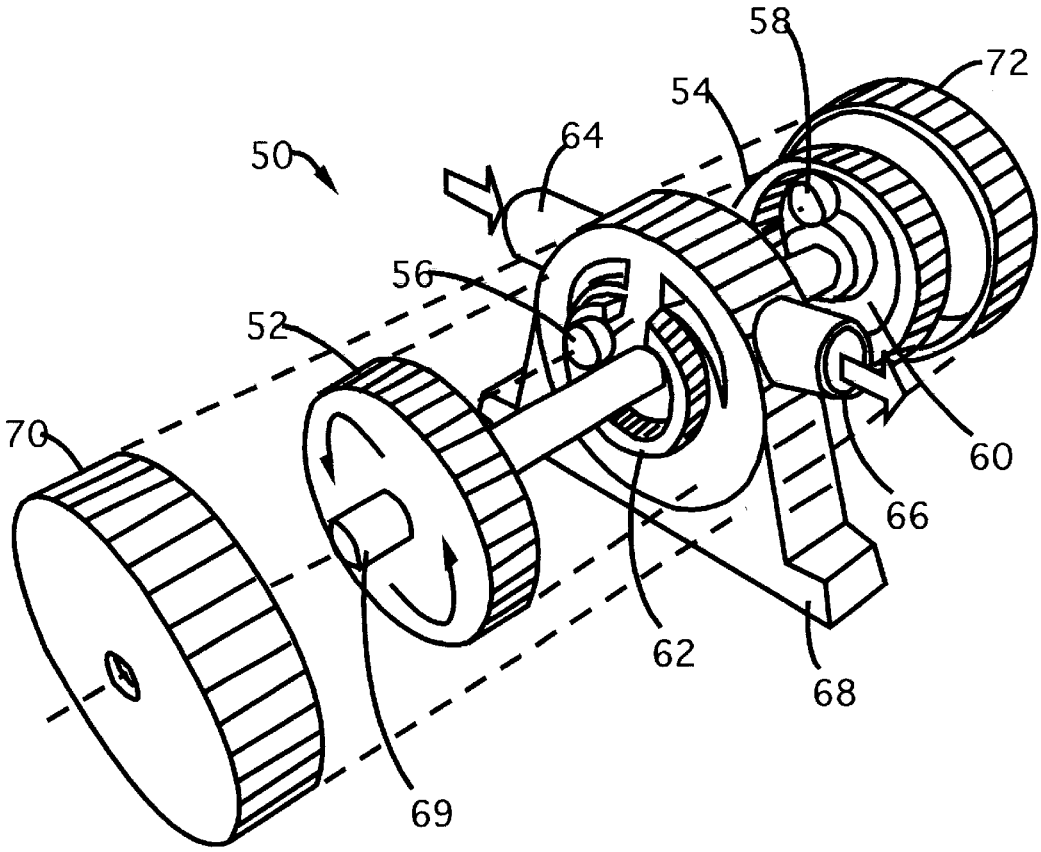
FIG. 3 shows an expanded view of the first pump as a double pump with two rotor discs with rotor grooves, and with the grooves 180° out of phase for non-pulsating flow.

FIG. 3 illustrates an alternative embodiment of the present invention, referred to herein as a dual rotary pump 50. The pump 50 resembles the single rotary pump 10 except that it has a pair of rotors 52 and 54 and a pair of abutments 56 and 58, compared to the single rotor 14 and abutment 28 of pump 10. An annular groove 60, visible in the rotor 54 in FIG. 3, is preferably 180° out of phase in its eccentricity about the axis compared to a similar annular groove (not shown) in the rotor 52. The annular groove in the rotor 52 receives a concentric land ring 62 that has a matching concentric land ring (not shown) disposed in the groove 60. An inlet port 64 and an outlet port 66 each open to both sides of a stator 68 and on both the radial inside and outside of the concentric land rings to provide pump flow in and out of the expansible chambers thus formed between the rotors 52 and 54 and the stator 68. A shaft 69 turns the rotors 52 and 54 when pumping occurs. A pair of end caps 70 and 72 seal to the stator 68. The operation of pump 50 is otherwise the same as that for the pump 10. In an alternative embodiment, the inlet and outlet porting between the two pumping halves on either side of the stator 68 can be configured to stage the pumping halves one before the other, e.g., in series. Such would be advantageous in pumping applications where larger pumping pressures are needed and the concomitant lower pumping volumes can be tolerated.

As demonstrated by FIG. 3, the present invention allows diverse applications by making multiple abutments, lobes and cavities very easy and straightforward to configure.

A single abutment in a single divided chamber will produce radial pulses and axial thrusts on a rotor. Two rotors in opposition, e.g., 180° out of phase, can reduce the net effect of such forces, but not totally eliminate the pulsing on the bearings. Faster pulse times and higher moving rotor and shaft momentum can reduce the adverse effects on the bearings. Such pulsing can be rapid where the number of chambers greatly exceeds the number of abutments. An even number of rotors tends to balance the loads. So only configurations with odd numbers of abutments will have such undesirable radial loads, and these can be minimized by making the number of cycles larger than the number of abutments.

Figure 4A:
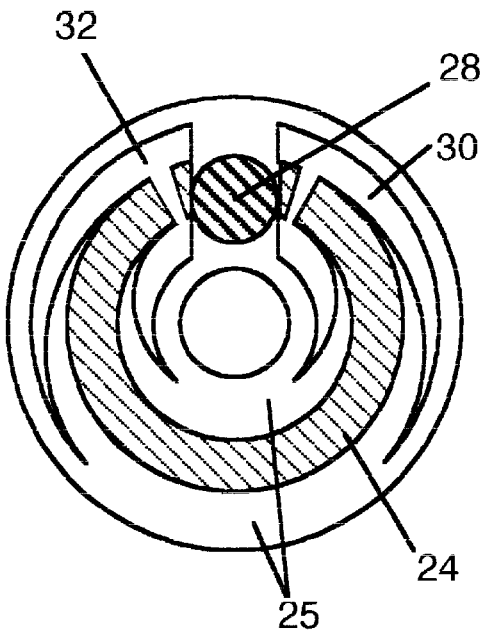
FIG. 4A is a cross section of the pump through the middle of the abutment. It shows the size of porting which can be achieved by using transitions, including porting through the land ring. The pump has a flat stator plate with protruding land ring and abutment guide slot, cross hatched port area, and pumping zones for inner and outer chambers.
Figure 4B:
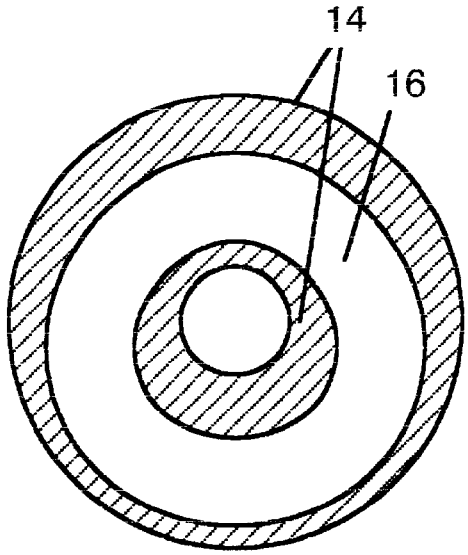
FIG. 4B is a cross section through the rotor for FIG. 4A at the height of the middle of the abutment. It shows the rotor with rotor groove having 120° sectors of constant radius and 60° sectors of changing radius.

FIGS. 4A–4B represents a single rotor 14 single abutment 28 embodiment. It could be duplicated and put 180° out of phase for a double pump joined to produce pulse free flow. To do this, the respective intake and discharge ports are joined to each other. FIG. 4A shows the optimum porting for the unit. It demonstrates how the constant rotor sectors determine the maximum allowed port size for the ports 30 and 32 without communication between intake and discharge ports. The land ring 24 has one or more sectors removed to allow porting to be continuous at all phases of operation. FIG. 4B shows the rotor 14 with the rotor groove 16 having sectors of constant radius and sectors of changing or transition radius.

Figure 5A:
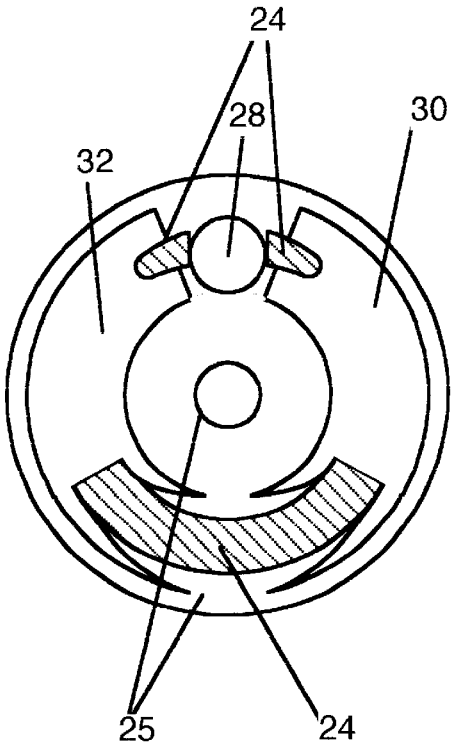
FIG. 5A is a cross section of another embodiment of the pump through the middle of the abutment. It shows the size of porting which can be achieved by omitting two of the three available cycles from the three lobe rotor, allowing a large amount of porting through the land ring. The white crescent zones adjacent to the land ring sector are the pumping zones.
Figure 5B:
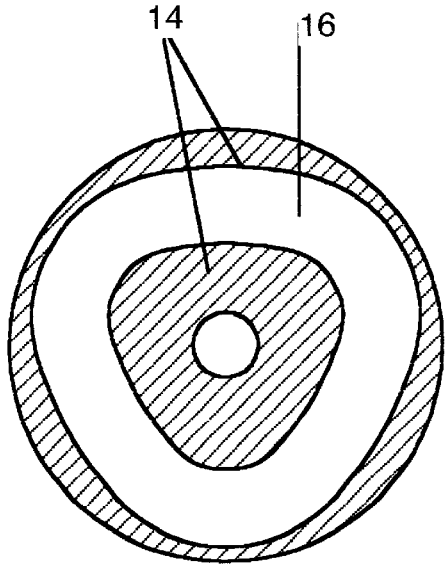
FIG. 5B is a cross section through the rotor for FIG. 5A at the height of the middle of the abutment. It shows a three lobed (three cycle) rotor with rotor groove having 10° sectors of constant radius and 50° sectors of changing radius.

FIGS. 5A–5B illustrate an embodiment of the present invention that uses a three lobed rotor with rotor groove 16. FIG. 5A shows stator 25 with a protruding land ring sector 24 (and land ring sector with a slot cut for the abutment). By choosing to drop two of the available three cycles in favor of porting, it allows use of larger intake and discharge ports 30 and 32. The white areas radially inward and radially outward from the land ring 24 are the areas in which pumping action occurs between land ring 24, stator 25, and rotor 14.

Figure 6A:
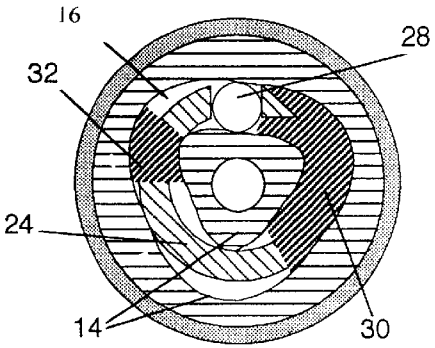
FIGS. 6A–6C that the land ring sector and associated ports may be rotated to chance the ratio of port area between the inlet and outlet ports.
Figure 6B:
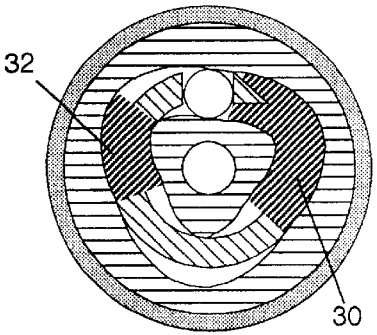
Figure 6C:
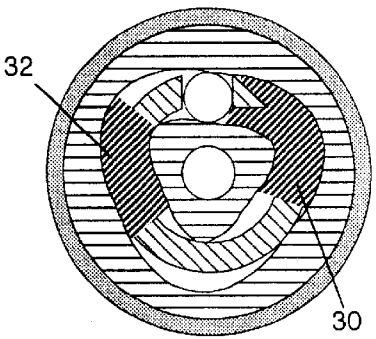

FIGS. 6A–6C show that the ratio of port area between the inlet port and discharge port may be varied in the pump described by FIGS. 5A–5B by rotating the land ring sector 24 and ports 30, 32. Generally, it is useful to provide a larger port area on the low pressure side to prevent cavitation.

In FIG. 6A, the abutment 28 separates intake port 30 from discharge port 32. The land ring sector 24 divides the groove 16 in the rotor 14.

In FIG. 6B, the land ring sector 24 and the ports 30 and 32 have been rotated to change the relative size of the ports so they are approximately equal.

In FIG. 6C, the land ring sector 24 and the ports 30 and 32 have been rotated to reverse the port sizes shown in FIG. 6A, so that the discharge port 32 is now larger than the intake port 30.

Figure 7:
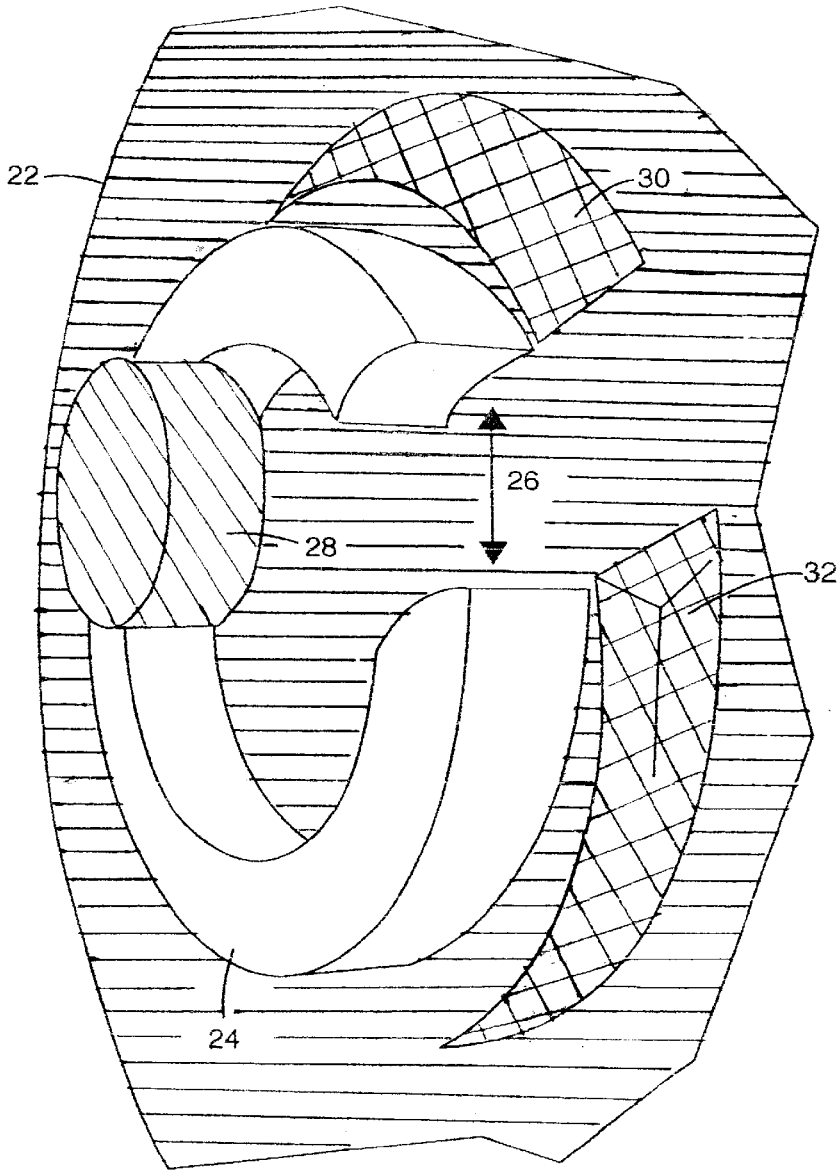
FIG. 7 shows the first pump stator end plate with land ring and ports, showing a curved slot as an abutment guide. This slot is shaped so that when the apparatus is used as a pump, the pressure against the abutment causes the abutment to traverse the slot with motion similar to a pendulum. In this way, the pressure (and hence the force) component against the abutment is in the direction of required accelerating and decelerating motion.

Referring now to FIG. 7, radial forces acting on the abutment 28 in one direction or another can be neutralized by one or more specific measures, e.g., to keep the abutment 28 from contacting the chamber walls. For example, the abutment 28 can be made of a solid material that is approximately equal in specific gravity to the fluid filling the chambers 18 and 20. Since the abutment 28 is typically completely immersed in such fluid, choosing materials such that the specific gravities are about equal would then support the abutment to readily follow the eccentric motion of the fluid around the groove 16. As shown in FIG. 7, the inside longitudinal limits of the slot 26 may also be curved toward the outlet port 32, to present a series of tangential point contacts between the circular abutment 28 and the inside longitudinal limits of the slot 26 that are perpendicular for every phase of the rotation cycle. The leakage on either radial contact with the chamber walls will center the abutment 28 in the groove 16 due to the balancing of the Bernoulli effect at both places. The hydrodynamic forces generated keep the abutment 28 from contacting the surface walls. Such forces are magnified with higher fluid viscosity.

Figure 8B:
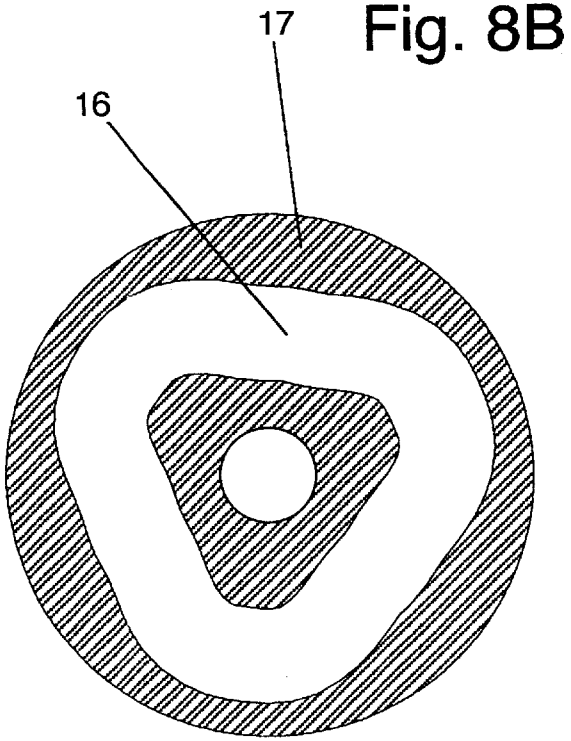
FIG. 8B is a cross section through the rotor for FIG. 8A at the height of the middle of the abutment. It shows a three lobed (three cycle) rotor with rotor groove having 10° sectors of constant radius and 50° sectors of changing radius.
Figure 8A:
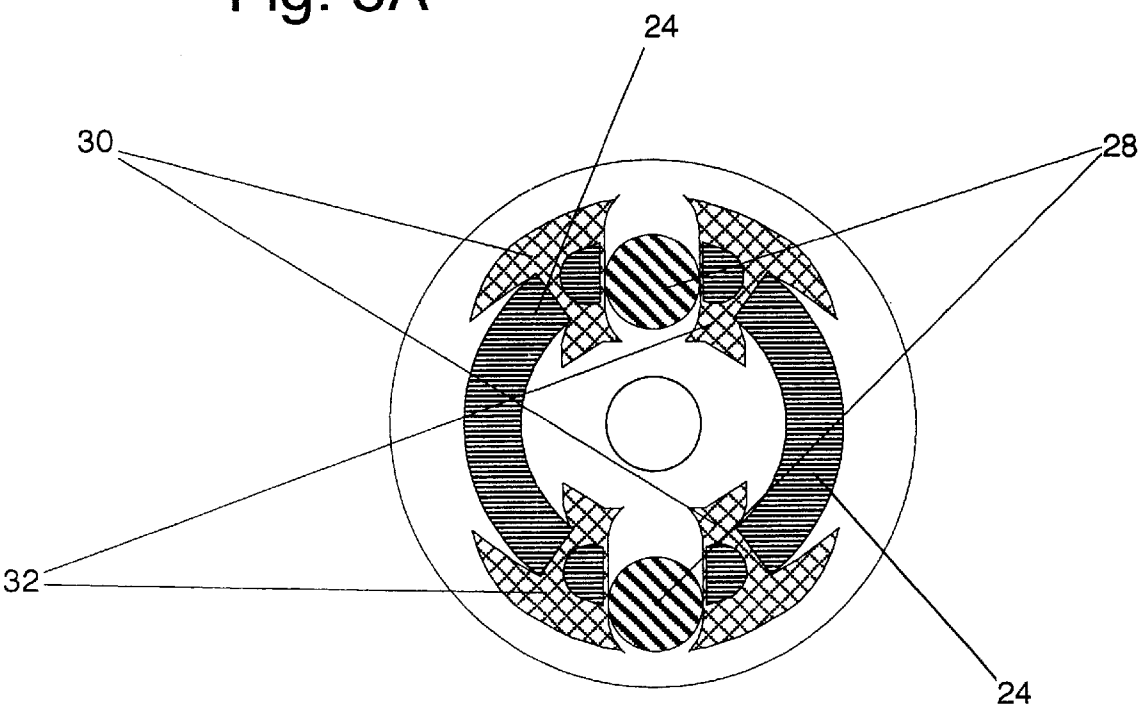
FIG. 8 is a cross section of another embodiment of the pump through the middle of the abutment. It shows two abutments, with associated ports, for use with a three lobe (three cycle) rotor. One cycle is dropped to allow an enlarged port area. Because the two remaining cycles are a half cycle out of phase, this pump provides non-pulsating flow by linking the inlet ports and linking the discharge ports.

FIGS. 8A and 8B show a dual chamber pump that is designed for constant flow. The inlet port(s) 30 and the outlet port(s) 32 are joined (not shown) in order to achieve constant torque and non-pulsating flow with a single rotor, two abutments, and single inlet and discharge.

Figure 9A:
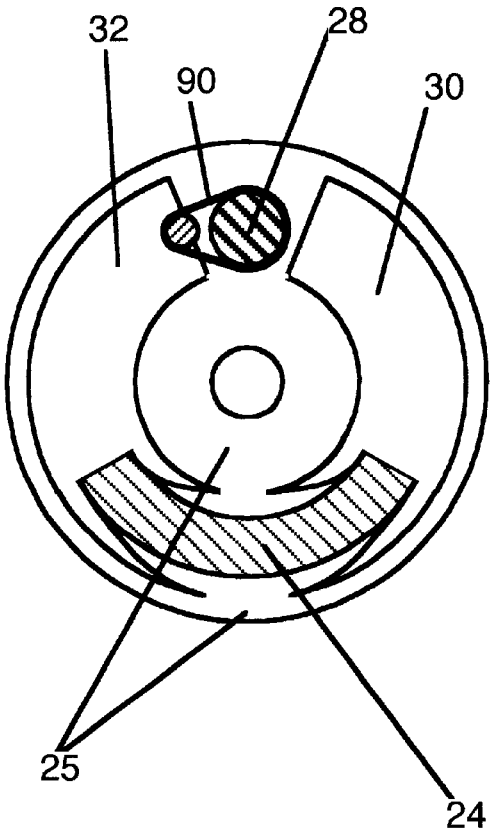
FIGS. 9A–9B show a pump as in FIG. 5 where the means to prevent the abutment from rotation is a pin which protrudes from the stator, with a flexible band around the pin and around a spacer which maintains the proper width of abutment.
Figure 9B:
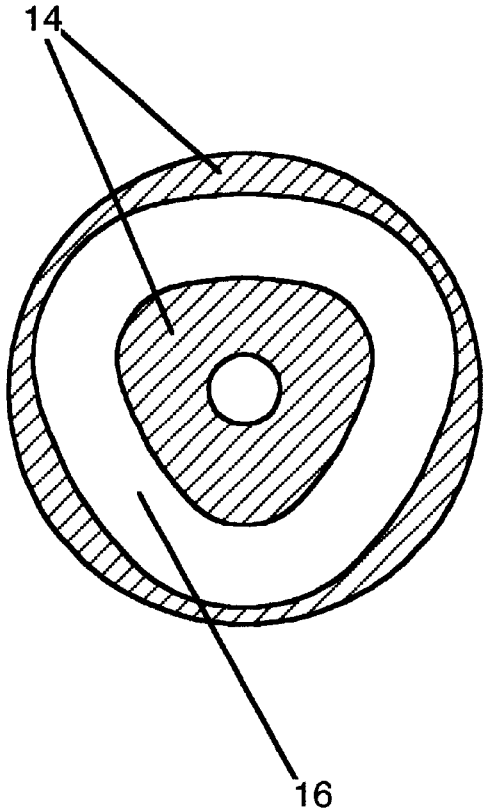

FIGS. 9A and 9B illustrate an abutment assembly 28 that consists of a flexible band 90 the axial depth of the chamber and containing a cylindrical spacer 28 to close off the rotor groove 16. It is made to pivot on a small shaft protruding from the stator 22. The purposes of the flexible member are:

- to avoid high rotational bearing loads which could occur on a pivoting member;
- to provide a wearing surface against the rotor groove walls which is continually changing its points of contact with the walls of the groove in order to minimize wear;
- to provide better fluid wedge action against the rotor groove walls; and
- to provide a pivoting mechanism whereby contact with either wall of the rotor groove tends to move it away from that wall rather than toward it.

FIGS. 10A–10L show cross sectional views of a three lobe, single abutment pump during a full 120° cycle, in 10° increments. These illustrate means for trapping fluid between the rotor groove 16, the land ring 24 and the abutment 28. Fluid is trapped in the volume enclosed by these three members. This trapped fluid is compressed by the rotary action and a force is exerted on the abutment 28 that causes it to move in the desired direction, away from this region of increased force. This concept is most useful in pneumatic applications.

Figure 11A:
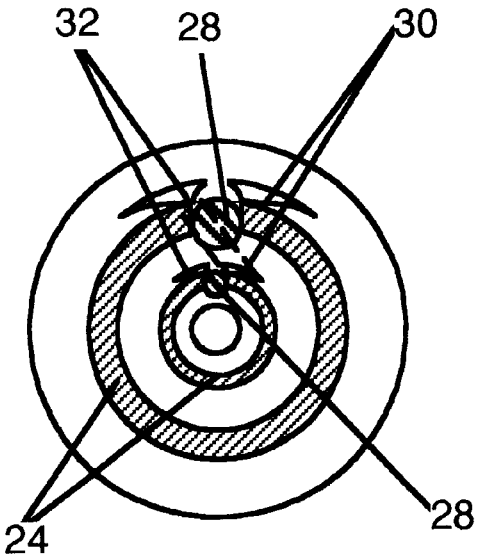
FIG. 11A is a cross section of an embodiment of this pump as a compressor, through the middle of the abutment. In this embodiment, the discharge from the outer groove is ducted to the intake of the inner groove as shown by the dotted line. A gas moving from the outer chamber into the inner chamber is compressed. The porting is timed so that all of the ports in the embodiment are closed at the same instant, preventing puffback from one stage to another.
Figure 11B:
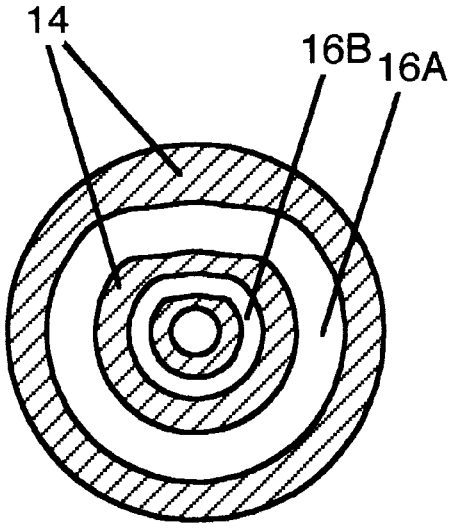
FIG. 11B is a cross section through the rotor for FIG. 11A at the height of the middle of the abutment. It shows a single lobed (one cycle) rotor with two concentric rotor grooves having 10° sectors of constant radius on the inside, 40° sectors of changing radius, and a 270° sectors of constant radius on the outside.

FIGS. 11A and 11B show cross sectional views of an embodiment as a compressor, which has two concentric grooves. 16A and 16B in the rotor, and corresponding land rings 24 in the stator. The pump is ported such that the discharge port 32 of the outer groove 16A is constantly ported into the intake port of the inner groove 16B. This increases the area where compression occurs, in order to prevent hot spots in the rotor 14. The ports are all closed simultaneously in order to avoid puffback.

Figures 12A, 12B:
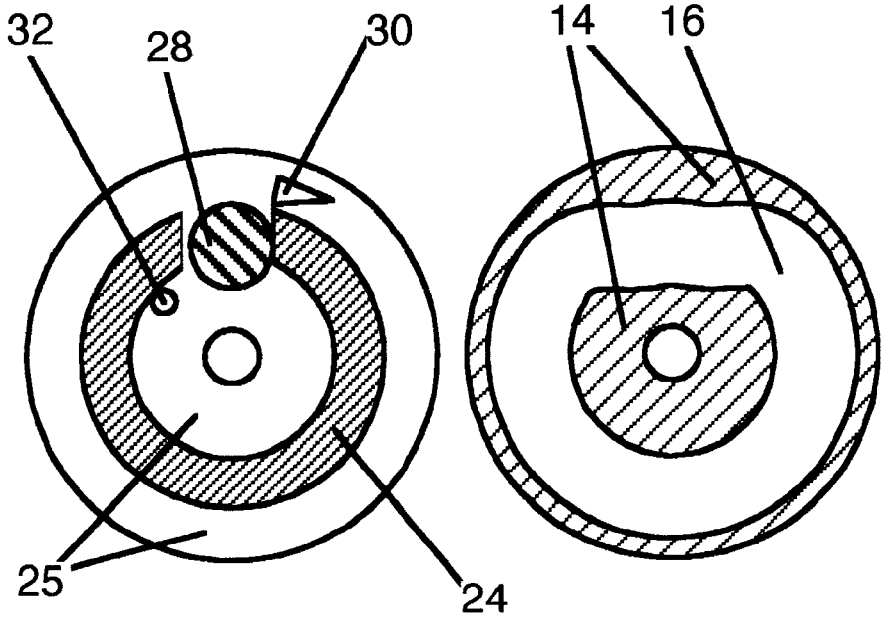
FIG. 12A is a cross section of a different embodiment of this pump, used as a compressor, through the middle of the abutment. In this embodiment, the outer chamber has no discharge port. Instead, the slot has a clearance that allows passage of gas from the outer chamber to the inner chamber. Thus, a gas is compressed from the outer chamber into the inner chamber. The inner chamber has a rotary valved discharge port for the compressed gas.
FIG. 12B is a cross section through the rotor for FIG. 12A at the height of the middle of the abutment. It shows a single lobed (one cycle) rotor with one rotor groove having 10° sectors of constant radius on the inside, 40° sectors of changing radius, and a 270° sectors of constant radius on the outside.
Figure 14A:
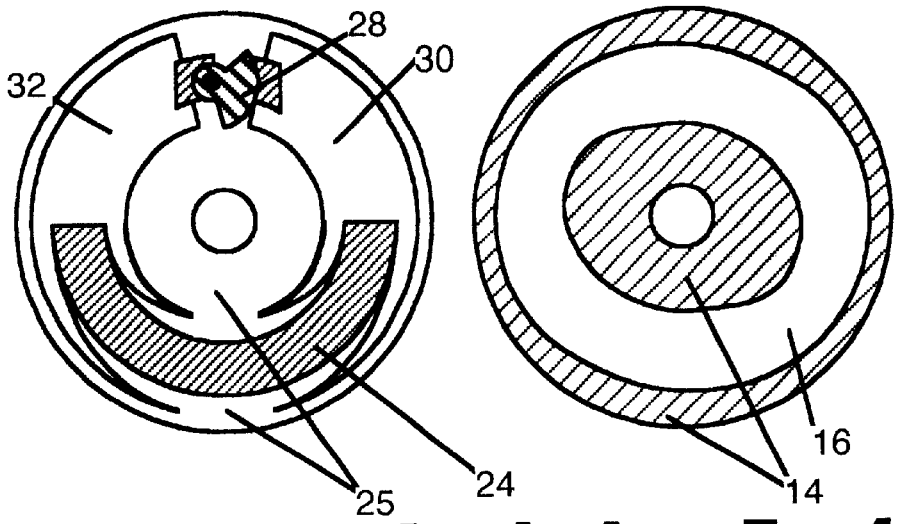
FIG. 14A is a cross section of another embodiment of the pump through the middle of the abutment. It shows a rotating abutment that is pivoted such that the widths of the inner and outer chambers are different. The inner chamber is wider than the outer chamber, with the pivot point and rotor size chosen so that the swept volume of the inner and outer chambers are equal. The purpose of this embodiment is to provide a single rotor, single groove pump-motor that has the inner chamber swept volume equal to the outer chamber swept volume for constant flow, constant torque operation.
Figure 14C:
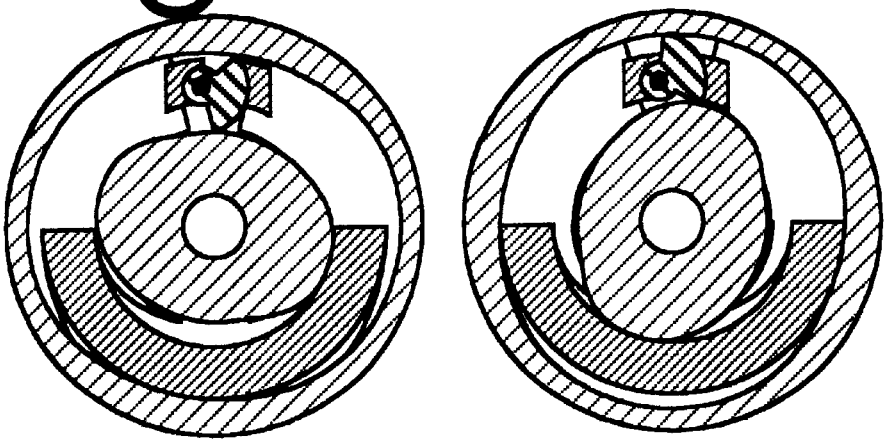

FIGS. 12A and 12B show cross sectional views of an embodiment as a compressor. It has a slot for an abutment 28 that is shown as a cylindrical abutment but which can also be a sliding vane. An intake port 30 is provided in the outer chamber 20 and a discharge port 32 is provided in the inner chamber 18. Fluid is drawn in through the intake port 30, forced around the periphery of the land ring, passes through the slot containing the abutment into the inner chamber. Since the inner chamber is so small, it is almost immediately discharged through the discharge port 32. Both ports are rotary valved by the rotation of the rotor, providing a simple compressor or expander.

FIG. 13A shows an axial cross section through the shaft of an embodiment of this mechanism designed to provide constant flow. It shows the formation of a radially inward chamber 75 and a radially outward chamber 76 where chamber 75 has a greater cross sectional area than chamber 76. FIG. 13B shows the stator end plate 25 with the protruding land ring 24 and a slot 80 in the land ring to accommodate a sliding abutment 28. This abutment runs the axial length of the chamber 75, requiring that the stator be notched to accommodate the longer abutment. This notch is shown by the dotted line in FIG. 13A. The swept volume of the inward chamber 75 is made equal to the swept volume of the outer chamber 76, resulting in a pump-motor having constant torque and non pulsating flow with a single rotor groove and a single abutment.

FIGS. 14A–14D show a two lobe rator, with a variable width groove 16 and a pivoting abutment 28. The pivot point is located radially inward from the radial center of the land ring 24, such that it moves further radially inward from the inner surface of the land ring than it moves radially outward from the outer surface of the land ring. Because of this, the inner chamber is radially wider than the outer chamber and the swept volume of the chambers may be made equal. This results in a pump of constant torque and non-pulsating flow, using a single groove and a single abutment, but where the rotor groove 16 is not of constant width.

In FIGS. 15A and 15B, the heat engine 200 includes a shaft 202 that connects to a multistage air compressor 204 having a pair of rotor parts 206 and a stator part 208. A compressed air pipe 210 connects a flow of compressed air into a regenerator 212 that recovers heat from an air flow brought in by a pipe 214. The outlet gases are then exhausted to the atmosphere. A pipe 216 carries the compressed and heat regenerated input air to be used in a combustor 218. The combustor is supplied with fuel from a fuel pump 230 by way of a fuel pipe 232. The fuel is ignited by a spark plug 234 and burns continuously thereafter. Heated gases from the combustor 218 are then circulated to an expander 220 to heat a stator 222 and a pair of rotors 224. A pipe 226 inputs the combustion gases to the expander 220 and pipe 214 carries the expanded gases away. The shaft 202 drives both rotors 206 and 224 and is used to output mechanical power. Fan blades 236 on the outer sides of the rotors can be used to maintain isothermal conditions.

The input air enters the outermost stage of the multistage compressor 204 and passes inward through each stage sequentially, although the interstage porting is not shown.

Heat can be added in the combustor 218 by either internal or external sources. The heated gases connected by pipe 226 are expanded to produce work in the expander 220.

In FIG. 15C, a cross-section through the combustor 218 showing the inlet pipe 216, the fuel pipe 232, the spark plug 234, and the outlet pipe 226.

In various pneumatic applications, the present invention lends itself to uses such as compressors, motors, and engines. The abutments are pressurized by the fluid at the required accelerations to prevent contact with the chamber walls. In such applications, the abutment is preferably constructed of materials that have high hardness and are heat resistant. The density of the abutment material should be as low as possible. Preferably, the chamber has a maximum cavity sector on the radially outward part of the land ring and a minimum inner chamber with a fast transition between outer and inner positions. The inner chamber is ported only to the discharge port. As a compressor, this provides a configuration with a very long stroke. Depending on how efficient the tolerance seals are, a number of stages may be required. A stator with a rotor on either side allows spiraled axially inward staging of the fluid, so that the pressure can be boosted in each stage.

The fluid to be exhausted can exit through the axis on one side and the rotor is cantilevered so that the rotor may be attached to a shaft. On the outer periphery of the two rotors, the rotors are joined and the outer radius is in close proximity to the stator abutment for porting a rotary inlet port. An exposed rotor may be equipped with air scoops to supercharge the inlet. The rotor should be of thermal conducting material to be finned for heat rejection.

A liquid and gas mixture can be pumped in embodiments of the present invention so that the gases are compressed and deliver heat to the liquid. This can be done by using a multi-lobed rotor, with one of the lobes pumping a liquid and the other(s) pumping a gas, or by pumping a mixture of liquid and gas. The mixture is allowed to separate under pressure and the separated liquid and gas are passed through separate motors to recover the energy of compression. The liquid seals the pump and acts as a heat sink. The gas delivers its heat of compression to the liquid and is expanded through an expander to produce refrigerated gas, such as air, and the liquid is either discarded after passing through the motor, if the liquid is water, or the discharged liquid can be heat exchanged to ambient and recycled.

In a particular embodiment, a single-groove double-opposed rotor pump was built of stainless steel. Two abutments with a specific gravity 1.14 were constructed of nylon and had a total weight of less than one ounce. Turning the input shaft at 1750 revolutions per minute (rpm) produced twenty gallons-per-minute (gpm) at a peak pressure of 190 pounds-per-square-inch (psi). Such pump has been in intermittent service as a salt water cooling pump on a marine diesel engine on a fishing boat for more than a year. Sand, gravel, seaweed and other organic matter has been observed passing through the pump, and the pump has been run dry as long as fifteen minutes at a time. Subsequent tear down inspections show no discernible wear on the expansible chamber walls nor wear to the nylon abutment discs. This pump, nevertheless, turns so easily that light finger pressure on the input shaft can turn the rotor. A flexible vane pump had previously been in service for the same application and a pipe wrench was ordinarily needed to turn its rotor shaft on the bench. This particular flexible vane pump had always needed an impeller replacement about once a year.

Many alternative embodiments of the present invention are possible. A pump-motor can be configured where two or more opposed abutments and associated cycle chambers are included for radial pressure balancing and increased flow and torque. A pump-motor can be configured in which an even number of abutments and an odd number of cycle chambers provide for non-pulsating flow from one rotor. A pump-motor can be configured in which the number of cycle chambers exceeds the number of abutments and the excess cycles have a sector of the land ring removed for increased porting. A pump-motor can be configured in which the position of the land ring sector determines where the pumping action takes place and allows the size of the ports to vary, particularly to allow large intake port versus discharge as a pump and vice-versa as motor. A pump-motor can be configured in which the pumping sector is a small angular part of the whole, and that radial bearing loads are minimized since the length of pumping chamber is small. A pump-motor can be configured in which the radial bearing load is highly oscillatory, which oscillation tends to cancel when angular momentum is considered. A pump-motor can be configured in which the pumping chamber is surrounded by rotor walls except land ring and abutment. A pump-motor can be configured in which the valve action is rotary ported into the stator through the walls. A pump-motor can be configured in which two rotors are provided, joined at their outer diameters and sandwiching a stator plate with land rings, abutments and rotary ports and including check valves, and where each rotor has one or more rotor grooves which stages across the stator into the opposite rotor and back again and the fluid is caused to spiral inward gaining pressure. A pump-motor can be configured in which the compressor has air scoops on its outer diameter (rotor), which rotary valves supercharged air into the compressor and is a conducting material that is cooled by the rotary motion. A pump-motor can be configured in which the unit is used as an expander and where the check valves are omitted and the rotor is of an insulating material. A pump-motor can be configured in which the compressor and expander are linked together to form a heat engine by adding a combustion chamber or a heat exchanger to achieve a refrigeration unit. A pump-motor can be configured with a single rotor cylinder having two grooves in the rotor. The grooves would be of a stepped design (one within the other), with the first groove wider and shallower. The second groove would be narrower, and would start at the bottom of the first groove. Each groove would have its own abutment, and the grooves would be one half-cycle out of phase to minimize pulsation and balance radial loads.

A pump-motor can be ported as a pump combination where both a liquid and gas are compressed simultaneously and the compressing gas gives its heat to the liquid, and the liquid also serving to provide better sealing and whereby the gas and liquid under pressure are separated and the pressurized fluids are expanded, gaining back energy of compression and the spent liquid is either discharged or heat exchanged and recycled and the expanding gas provides refrigeration.

Although particular embodiments of the present invention have been described and illustrated, such is preferably not intended to limit the present invention. Modifications and changes will no doubt become apparent to those skilled in the art, and it is preferably intended that the present invention only be limited by the scope of the appended claims.

What is claimed is:

1. An expansible chamber is apparatus comprising:

a stator housing;

a shaft and bearings rotating within the stator housing and having a cylindrical rotor fixed to the shaft for concentric rotation about the shaft rotation axis;

the cylindrical rotor having at least one axial end and having at least one continuous groove in the rotor axial end, with the groove having a radially inward surface and a radially outward surface, having constant width from any point on the radially inward surface to its nearest point on the radially outward surface and having constant axial depth;

the groove having a plurality of constant radial distance sectors where the radial distance from the rotation axis to a groove center is constant and having a pluraity of transitional radial distance sectors where the radial distance from the rotation axis to a groove center is variable;

the rotor rotating with its axial end in close proximity to an axial stator face of the housing, and the stator having a land ring with an end face, where the land ring is axially concentric with the rotation axis and extends into the rotor groove to form a close proximity seal between the land ring end face and the axial end face of the groove, where the land ring divides the rotor groove into an inner groove chamber and an outer groove chamber and always forms tolerance seals at the constant radius sectors of the rotor groove on the radially inward surface and on the radially outward surface of the rotor groove;

at least one abutment that further divides the groove in an approximately circumferential direction by providing a radially oriented surface that fits the rotor groove cross section and that is allowed to move approximately radially to accommodate the position of the rotor groove as the groove rotates and as the radial distance from the groove center to the rotation axis moves inward or outward during the transitional radius sectors, the abutment being allowed to move on a projection from the axial stator face at a radial distance from the rotation axis that is approximately equal to the radial distance of a center of the land ring from the rotation axis and being free to be moved by a fluid that flows in the groove;

one slot in the land ring for each abutment, with each abutment located in its own abutment slot; and an intake port and a discharge port, located on opposite sides of the abutment, such that the port boundaries are defined by the abutment and such distance around the axis of rotation as allowed by the length of constant radius of the groove on either side such that the ports do not communicate with each other.

2. The chamber of claim 1, wherein in addition to having one abutment slot in the land ring for each abutment with each abutment located in its own slot, said land ring is segmented and at least one land ring segment can be removed in at least one selected sector of said groove.

3. The chamber of claim 1, wherein said rotor has a plurality of pairs of inner groove chambers and outer groove chambers, formed by said sectors of constant radial distance and by said sectors of transition radial distance in said rotor groove and by said land ring, with at least one pair of an inner groove chamber and an outer groove chamber including an abutment and the abutment's corresponding slot in the land ring.

4. The chamber of claim 1, wherein said constant radial distance sectors of said rotor groove have sufficient extent to allow at least one of said intake port and said discharge port to be extended and to allow at least one further portion of said land ring to be removed so that the extended port becomes continuous across the region previously occupied by the removed portion of said land ring.

5. The chamber of claim 1, further comprising a second rotor groove in said rotor and a second abutment that moves approximately radially in the second groove, said first outer groove chamber and said second inner groove chamber form a first fluid pump chamber, the second outer groove chamber and second inner groove chamber form a second fluid pump chamber, the first fluid pump chamber and the second fluid pump chamber share said intake port and share said discharge port, and flow of fluid through said first rotor groove and through the second rotor groove are approximately 180° out of phase with each other.

6. The chamber of claim 1, wherein said land ring is positioned with a selected angular offset to provide said intake port and said discharge port with a selected ratio of intake port size to discharge port size.

7. The chamber of claim 1, wherein said rotor provides for trapping of a portion of said fluid that moves in said groove, for an increase of fluid pressure due to presence of the trapped fluid, and for movement of said abutment in a selected radial direction in response to the increases in fluid pressure.

8. The chamber of claim 1, wherein said abutment is balanced in said groove so that there is little or no force vector directed radially inward on the walls of said groove, little or no force directed radially outward on the walls of said groove, and said abutment is moved radially primarily by hydrostatic and hydrodynamic pressure exerted on said abutment.

9. The chamber of claim 8, utilized as a motor, wherein said abutment is approximately cylindrical and moves in an abutment slot, said slot having a width equal to width of the cylinder and having a length approximately equal to the radial width of said land ring, whereby a component of pressure on said abutment directed toward walls of said rotor groove is in the same direction as the motion required of said abutment during transition either radially inward or radially outward.

10. An expansible chamber apparatus comprising:

a stator housing;

a shaft and bearings rotating within the stator housing and having a cylindrical rotor fixed to the shaft for concentric rotation about the shaft rotation axis;

the cylindrical rotor having at least one axial end and having at least one continuous groove in the rotor axial end, with the groove having constant width and constant axial depth;

the groove having a radially inward surface and a radially outward surface, having a plurality of constant radial distance sectors where the radial distance from the rotation axis to a groove center is constant and having a plurality of transitional radial distance sectors where the radial distance from the rotation axis to a groove center is variable;

the rotor rotating with its axial end in close proximity to an axial stator face of the housing, and the stator having a land ring with an end face, where the land ring is axially concentric with the rotation axis and extends into the rotor groove to form a close proximity seal between the land ring end face and the axial end face of the groove, where the land ring divides the rotor groove into an inner groove chamber and an outer groove chamber and always forms tolerance seals at the constant radius sectors of the rotor groove on the radially inward surface and on the radially outward surface of the rotor groove;

a selected number of abutments that each further divides the groove in an approximately circumferential direction by providing a radially oriented surface that fits the rotor groove cross section and that is allowed to move approximately radially to accommodate the position of the rotor groove as the groove rotates and as the radial distance from the groove center to the rotation axis moves inward or outward during the transitional radius sectors, the abutment being allowed to move on a projection from the axial stator face at a radial distance from the rotation axis that is approximately equal to the radial distance of a center of the land ring from the rotation axis and being free to be moved by a fluid that flows in the groove;

one slot in the land ring for each abutment, with each abutment located in its own abutment slot;

the rotor having a plurality of pairs of inner groove chambers and outer groove chambers, formed by the sectors of constant radial distance and by the sectors of transition radial distance in the rotor groove and by the land ring, where at least one pair of an inner groove chamber and an outer groove chamber includes an abutment, where the selected number of abutments is less than the plurality of pairs of chambers; and an intake port and a discharge port, located on opposite sides of the abutment, such that the port boundaries are defined by the abutment and such distance around the axis of rotation as allowed by the length of constant radius of the groove on either side such that the ports do not communicate with each other.

11. The chamber of claim 10, wherein said apparatus has a plurality of said abutments with corresponding abutment slots in said land ring, said rotor groove has a plurality of said chambers, the number of said chambers exceeds the number of said abutments by an odd number.

12. The chamber of claim 10, further comprising:

at least a first and a second of said pairs of chambers and at least a first and a second of said abutments and corresponding abutment slots, whereby a first pump for pumping a selected liquid and a second pump for pumping a selected gas are formed.

13. The chamber of claim 10:

wherein said rotor groove has a relatively long outer constant radius sector chamber and has a relatively short transition radius sector, whereby said outer chamber is larger than said inner chamber;

wherein each said abutment slot has a larger width than the diameter of said abutment so that gas can flow between said inner chamber and said outer chamber; and wherein said intake port communicates with said outer chamber through said stator, said discharge port communicates with said inner chamber through said stator, and said rotor lobe forms a rotary valve in each of said inner chamber and said outer chamber.

14. The apparatus of claim 13, wherein said rotor has at least first and second of said rotor grooves that are concentric, with each groove having a large outer constant radius sector, a relatively short transition radius sector and a relatively short inner chamber.

15. The chamber of claim 14, wherein a pair of said rotors with said chambers are mounted on one shaft, and one chamber functions as a fluid compressor while the second chamber functions as a fluid expander, the apparatus being further characterized by:

a combustion chamber that receives said fluid from said first chamber and that discharges said fluid into said second chamber, where said second rotor groove has greater swept volume than said first rotor groove;

pumping means for pumping a selected fuel into said combustion chamber; and a fuel ignition mechanism, located within the combustion chamber, for igniting fuel within the combustion chamber.

16. The apparatus of claim 15, further comprising at least one cooling fin that thermally communicates with said combustion chamber.

17. An expansible chamber apparatus comprising:

a stator housing;

a shaft and bearings rotating within the stator housing and having a cylindrical rotor fixed to the shaft for concentric rotation about the shaft rotation axis;

the cylindrical rotor having at least one axial end and having at least one continuous groove in the rotor axial end, with the groove having constant width and constant-axial depth;

the groove having a radially inward surface and a radially outward surface, having a plurality of constant radial distance sectors where the radial distance from the rotation axis to a groove center is constant and having a plurality of transitional radial distance sectors where the radial distance from the rotation axis to a groove center is variable;

the rotor rotating with its axial end in close proximity to an axial stator face of the housing, and the stator having a land ring with an end face, where the land ring is axially concentric with the rotation axis and extends into the rotor groove to form a close proximity seal between the land ring end face and the axial end face of the groove, where the land ring divides the rotor groove into an inner groove chamber and an outer groove chamber and always forms tolerance seals at the constant radius sectors of the rotor groove on the radially inward surface and on the radially outward surface of the rotor groove;

at least one abutment that further divides the groove in an approximately circumferential direction by providing a radially oriented surface that fits the rotor groove cross section and that is allowed to move approximately radially to accommodate the position of the rotor groove as the groove rotates and as the radial distance from the groove center to the rotation axis moves inward or outward during the transitional radius sectors, the abutment being allowed to move on a projection from the axial stator face at a radial distance from the rotation axis that is approximately equal to the radial distance of a center of the land ring from the rotation axis and being free to be moved by a fluid that flows in the groove, the abutment having a mass density that is approximately equal to the mass density of the fluid; and one slot in the land ring for each abutment, with each abutment located in its own abutment slot;

an intake port and a discharge port, located on opposite sides of the abutment, such that the port boundaries are defined by the abutment and such distance around the axis of rotation as allowed by the length of constant radius of the groove on either side such that the ports do not communicate with each other.

18. The chamber of claim 17:

wherein said rotor end has a cross sectional shape of a stepped surface cylinder, with an inner portion of the cylinder having a greater axial length than an outer portion of the cylinder, wherein said stator has a stepped end surface that complements the stepped surface of the cylinder, with a portion of said stator that is inside the land ring being recessed further than a portion of said stator that is outside the land ring so that said inner chamber is deeper than said outer chamber;

wherein said abutment has a width approximately equal to said width of said rotor groove and said abutment and corresponding abutment slot has a depth approximately equal to said depth of said inner chamber; and wherein said inner chamber depth and said outer chamber depth are selected so that said inner chamber and said outer chamber have approximately equal swept volume.

19. An expansible chamber apparatus comprising:

a stator housing;

a shaft and bearings mounted for rotation within said stator housing and having a cylindrical rotor fixed to said shaft for concentric rotation;

the cylindrical rotor having at least one planar axial end face which has at least one smooth continuous groove in said end face, said groove having constant width and constant axial depth and said groove being not concentric with said shaft axis, said rotor rotating with its axial end face in close contact with a planar axial stator end face;

said stator face having a projecting land ring, said land ring being concentric with said axis of rotation and said land ring having a planar end face and said land ring extending into said rotor groove so that the land ring planar end face is in close proximity with the planar bottom of the rotor groove, said land ring having a depth equal to the depth of the rotor groove, and said land ring being in close contact for a tolerance seal with at least one tangent line on outward surface of said rotor groove and at least one tangent line on the inward rotor groove surface such that said land ring divides said rotor groove chamber into at least two chambers;

said chambers totally enclosing the fluid momentarily at one position of rotation of the rotor for each chamber and for all other positions maintaining at least one tolerance seal between the suction side and discharge side so that the two never communicate;

at least one abutment that further divides the rotor groove chamber in an approximately circumferential direction by providing a radially oriented surface that fits the rotor groove being the same width and depth as said rotor groove, said abutment being allowed to move approximately radially to follow the surface of the rotor groove as the rotor rotates, said abutment having a contoured shape to provide a fluid wedge between said abutment and said rotor groove inward and outward so that said fluid wedge causes said abutment to move radially inward and outward and said abutment being restrained from circumferential motion by a projection from said stator end face, said projection providing a surface upon which said abutment is balanced for a pivoting, rolling, or sliding motion and said abutment having a specific gravity approximately equal to that of the pumped fluid and intake and discharge ports located either side of the abutment through the stator end face and which are curved and triangular in shape with one leg of the shape being the boundary of the abutment and the other two legs being the shape of the rotor groove in its upper and lower position, both said intake port and said discharge ports having a teardrop shaped port opening located radially inward of the land ring and also radially outward of the land, said ports being joined in the ducting, and said ports extending circumferentially so as to allow fluid to be drawn in and out over a large angle of rotation for each port;

and one slot in the land ring for each abutment, with each abutment located in its own abutment slot.

* * * * *